US006848543B2

(12) United States Patent
Adifon et al.

(10) Patent No.: US 6,848,543 B2
(45) Date of Patent: Feb. 1, 2005

(54) SINGLE WALL INTERFACE TRACTION ELEVATOR

(75) Inventors: Leandre Adifon, Farmington, CT (US); Pedro Baranda, Alcabideche (PT); Marc Chevilliard, Gien (FR); Jean Marc Ferrary, Paris (FR); Ron Laliberte, Prospect, CT (US); Pascal Rebillard, Gien (FR); Fernando Rico, Rueil Malmaison (FR); Armando Servia, Madrid (ES); Alberto Vecchiotti, Middletown, CT (US)

(73) Assignee: Otis Elevator Company, Farmington, CT (US)

( * ) Notice: Subject to any disclaimer, the term of this patent is extended or adjusted under 35 U.S.C. 154(b) by 74 days.

(21) Appl. No.: 10/295,629

(22) Filed: Nov. 15, 2002

(65) Prior Publication Data

US 2003/0121727 A1 Jul. 3, 2003

Related U.S. Application Data

(62) Division of application No. 09/183,262, filed on Oct. 30, 1998, now abandoned.

(51) Int. Cl.[7] ..... B66B 11/08
(52) U.S. Cl. ..... 187/254; 187/264
(58) Field of Search ..... 187/254, 264, 187/266

(56) References Cited

U.S. PATENT DOCUMENTS

| | | | | |
|---|---|---|---|---|
| 1,051,335 A | | 1/1913 | King | |
| 1,071,309 A | | 8/1913 | Goggin | |
| 1,702,783 A | | 2/1929 | Kiesling | |
| 2,088,690 A | | 8/1937 | Crispen | |
| 3,101,130 A | | 8/1963 | Bianca | |
| 3,739,881 A | | 6/1973 | Cilderman et al. | |
| 4,664,230 A | | 5/1987 | Olsen | |
| 4,949,815 A | | 8/1990 | Pavoz | |
| 5,076,398 A | * | 12/1991 | Heikkinen | 187/266 |
| 5,370,205 A | * | 12/1994 | Vanhala | 187/264 |
| 5,429,211 A | | 7/1995 | Aulanko et al. | |
| 5,435,417 A | | 7/1995 | Hakala | |
| 5,469,937 A | | 11/1995 | Hakala et al. | |
| 5,490,578 A | | 2/1996 | Aulanko et al. | |
| 5,788,017 A | * | 8/1998 | Wittur et al. | 187/266 |
| 5,833,031 A | * | 11/1998 | Liebetrau et al. | 187/239 |
| 6,193,017 B1 | * | 2/2001 | Koster | 187/264 |
| 6,397,975 B1 | * | 6/2002 | Rutten | 187/266 |
| 6,655,500 B2 | * | 12/2003 | Orrman et al. | 187/254 |

FOREIGN PATENT DOCUMENTS

| | | |
|---|---|---|
| AU | 1032496 | 6/1958 |
| DE | 003922798 | 9/1990 |
| DE | 29615921 U1 | 4/1997 |
| EP | 000372577 | 6/1990 |
| EP | 0606875 A1 | 1/1994 |
| EP | 0779233 A2 | 6/1994 |
| EP | 0784030 A2 | 6/1994 |
| EP | 000611724 | 8/1994 |
| EP | 0688735 A2 | 6/1995 |
| EP | 0710618 A2 | 10/1995 |
| EP | 0749930 A2 | 6/1996 |
| EP | 0749931 A2 | 6/1996 |
| FR | 2640604 | 12/1988 |
| GB | 000009019 | 4/1910 |
| GB | 002148229 | 5/1985 |
| GB | 2138397 B | 11/1985 |
| GB | 22-1657 B | 8/1990 |
| JP | 1-242386 | 9/1989 |
| WO | WO 96/09978 | 4/1996 |

* cited by examiner

*Primary Examiner*—Eileen D. Lillis
*Assistant Examiner*—Thuy v. Tran

(57) ABSTRACT

An elevator system (1) includes a guide rail bracket (10) attached to a single hoistway wall (20). Car guide rails (5) and counterweight guide rails (6) are fixed to the bracket (10). The counterweight guide rails (6) are positioned in between the car guide rails (5) so that the counterweight (11) can translate therebetween. The elevator car (8) is supported by rope (4) and sheave (2, 3) members coupled to a traction drive (16).

1 Claim, 6 Drawing Sheets

FIG.4
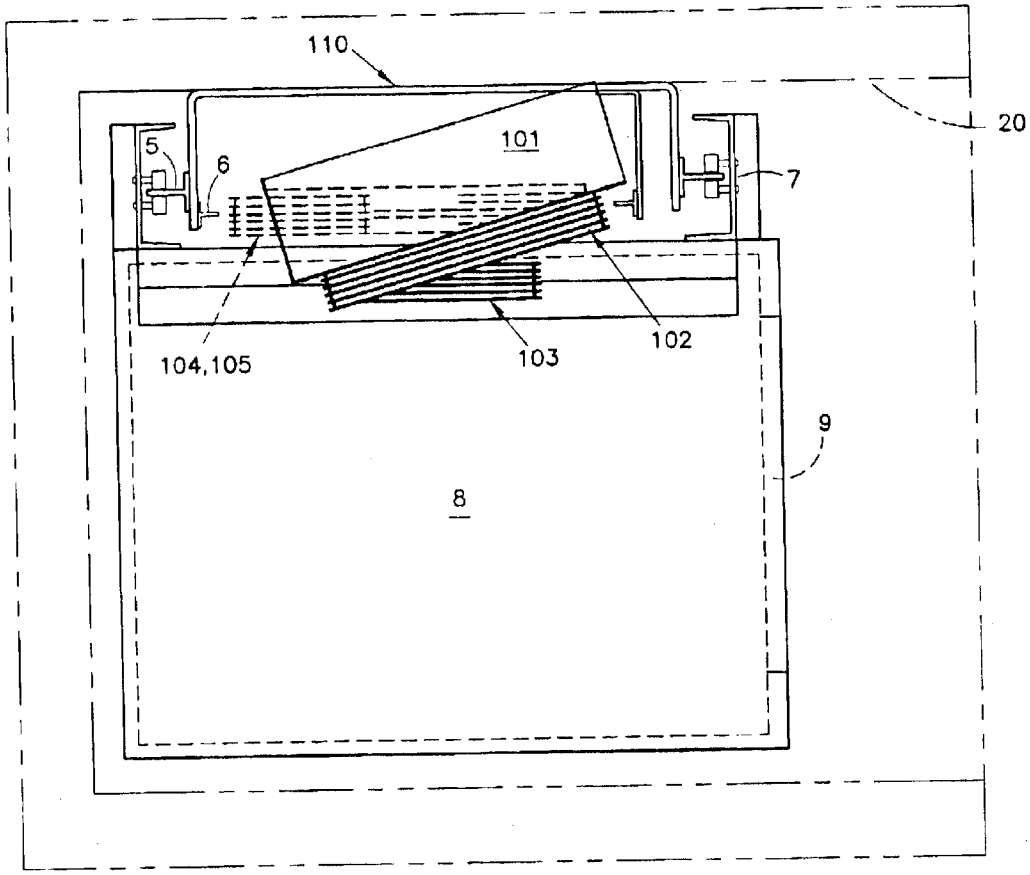
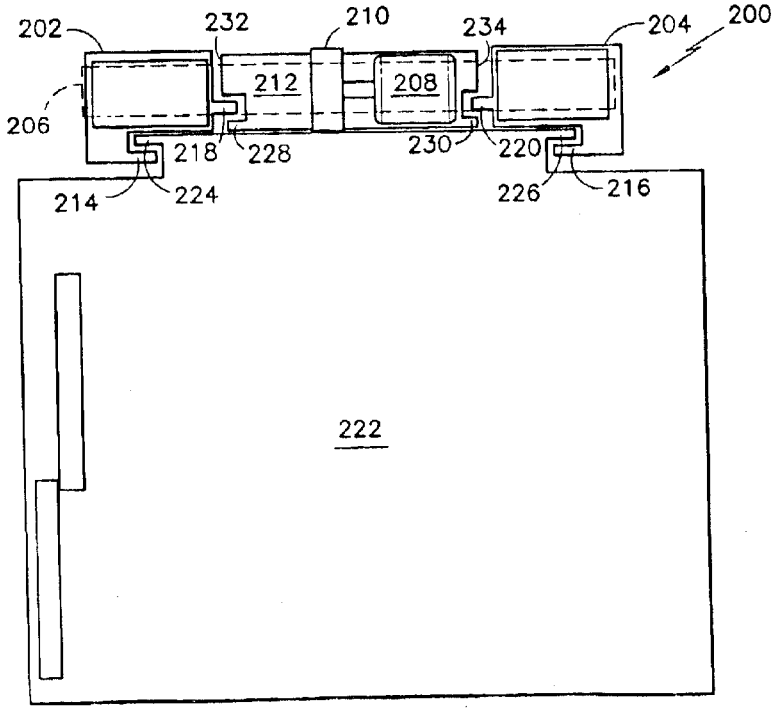
FIG.5

SINGLE WALL INTERFACE TRACTION ELEVATOR

This is a division of application Ser. No. 09/183,262 filed Oct. 30, 1998, now abandoned the contents of which are incorporated herein by reference.

TECHNICAL FIELD

The present invention relates to elevator systems and, more particularly, to elevator systems utilizing multi-functional structural components that support both elevator car and counterweight guide tracks in a manner requiring minimal hoistway space and that enable high efficeincy in operation and installation.

BACKGROUND OF THE INVENTION

Known elevator systems typically confine all elevator components to the hoistway or the machine room. The hoistway is an elongated, vertical shaft having a rectangular base in which the elevator car translates. The hoistway houses, among other things, the car guide rails which are usually a pair of generally parallel rails, fixed to opposite walls near the center of each wall, and running the approximate length of the hoistway. A counterweight having a pair of guide rails is positioned adjacent to a third wall. The hoistway houses additional components including terminal landing switches, ropes and sheave arrangements, and buffers for the counterweight and the car.

It is essential that the elevator components are located and oriented with precision prior to and during operation. The interior walls of the hoistway must be properly dimensioned and aligned, and the physical interface between the hoistway walls and the elevator components must be capable of withstanding varying load during use. It is particularly essential that the guide rails on which the car rides are properly positioned and solidly maintained. For quality of ride and safety, the guide rails need to be precisely plumb, square and spaced to avoid car sway, vibration and knocking. Guide rails are typically steel, T-shaped sections in sixteen foot lengths. The position of guide rails within the hoistway affects the position of the hoisting machine, governor and overhead (machine room) equipment. The machine room is typically located directly above the hoistway. The machine room houses the hoist machine and governor, the car controller, a positioning device, a motor generator set, and a service disconnect switch.

An elevator system designed to conserve space and simplify installation is disclosed in U.S. Pat. No. 5,429,211, in which counterweight guiderails and one elevator guiderail are positioned generally against one hoistway wall. The second elevator guiderail, however, requires mounting on the opposite hoistway wall.

Because the various components of the hoistway and machine room require precise positioning and they produce varying and substantial loads, it is costly and complicated to assemble a typical traction elevator system.

OBJECTS AND SUMMARY OF THE INVENTION

It is an object of the present invention to provide a novel elevator arrangement which overcomes the above-mentioned shortcomings and others by simplifying the assembly and positioning of components. The elevator system of the present invention eliminates the need for a machine room, eliminates forces on the roof of the hoistway, reduces the size of the hoistway needed to accommodate the elevator system, and minimizes the number of physical interfaces with the building. By minimizing the number of interfaces with the building, installation time and cost are reduced.

The present invention elevator system utilizes a cantilever car frame design that requires only one active wall in the hoistway, such that brackets and guide rails need only be attached to one wall rather than two as with conventional elevator systems. Further, the novel design of the present invention enables two adjacent elevator entrances in addition to opposite entrances. The guide rails for both the car and the counterweight are uniquely mounted to a bracket that, in turn, is mounted to a single wall. The counterweight guide rails are fixed to the bracket so that they are positioned in between the car guide rails. If desired, a series of similar brackets may be used in the same manner and lined up vertically in succession.

BRIEF DESCRIPTION OF THE DRAWINGS

FIG. 4 is a partial, top view of the elevator system illustrated in FIG. 3.

FIG. 5 is a schematic, cross-sectional top vew of an elevator system according to a third embodiment of the present invention.

DESCRIPTION OF THE PREFERRED EMBODIMENTS

Figure 1:
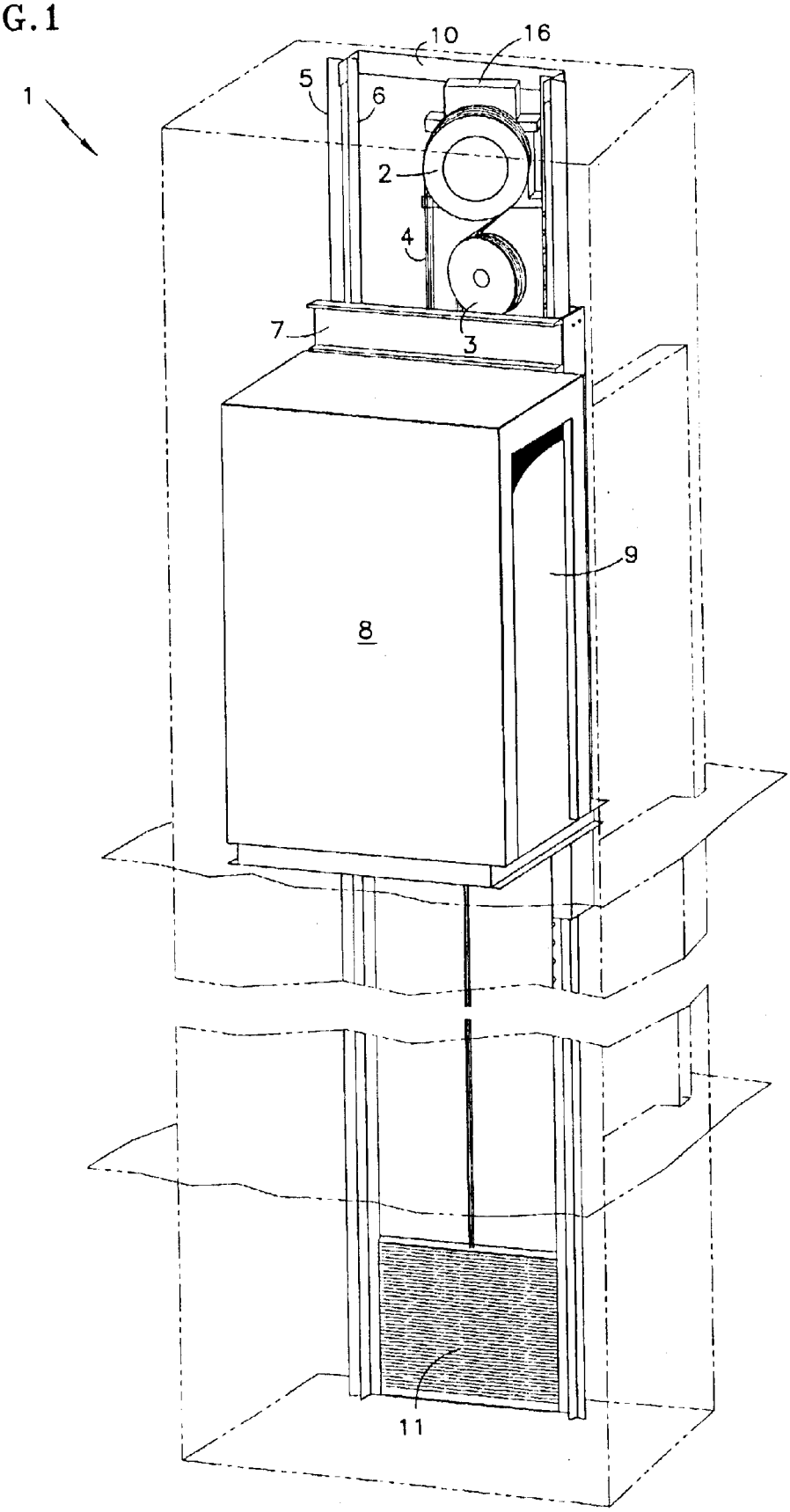
FIG. 1 is a schematic, partial, perspective view of an elevator system of a first embodiment of the present invention shown in a hoistway.
Figure 2A:
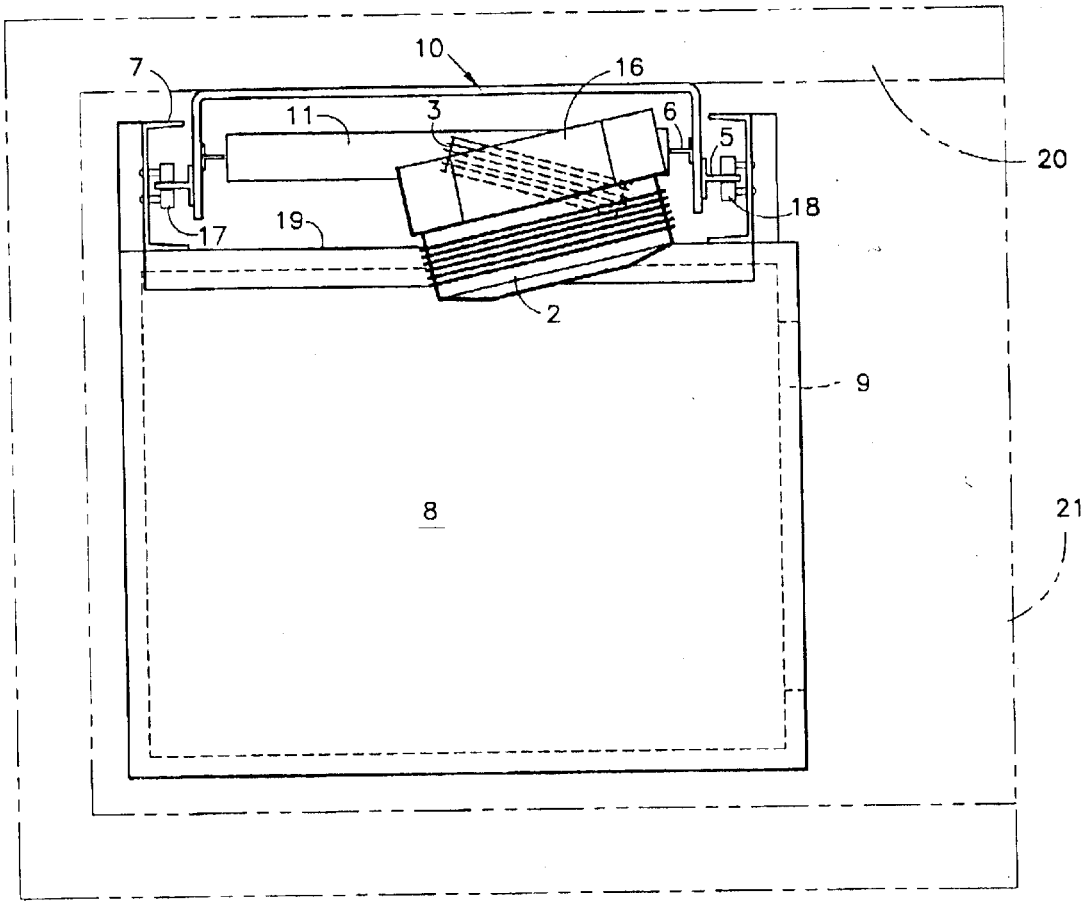
FIG. 2A is a partial, top view of the elevator system illustrated in FIG. 1.
Figure 2B:
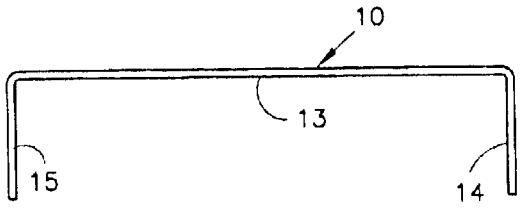
FIG. 2B is a partial, top view of a component of the elevator system of FIG. 1.

A first preferred embodiment, as shown in FIGS. 1 and 2, is directed to a 1:1 rope configuration. The elevator system (1) includes ropes (4) that pass through a traction or drive sheave (2) mounted to a planetary-geared flat machine (16). Various known machine types may be employed and the present invention embodiment is not limited to planetary-geared machines. The ropes (4) are attached to a counterweight (11) at one end and to the car (8) at the other. A counterweight deflection sheave (3) is provided to align the ropes (4) with the center of the counterweight (11). A bracket (10) is provided which, as shown in FIGS. 2 and 2A, comprises a squared "C" shape, having a middle section (13), and first and second end sections (14, 15) which are generally orthogonally aligned with respect to the middle section (13).

As shown in FIG. 2, a bracket (10) holds both the car guide rails (5) and the counterweight guide rails (6). The car guide rails (5) are each positioned on an outward facing surface of one of the first and second end sections (14, 15) of the bracket (10). The counterweight guide rails (6) are each positioned on an inward facing surface of one of the first and second end sections (14, 15) of the bracket (10). The counterweight guide rails (6) face each other and are aligned vertically and parallel. The counterweight (11) is positioned between the guide rails (6) for vertical translation. The counterweight (11) may be configured as having a width sufficient to enable it to be made from concrete, although it may be made from any suitable material.

The car guide rails (5) are aligned vertically and parallel, and are positioned facing away from each other, so that a car frame (7) configured with inwardly facing guide shoes (17, 18) may engage the guide rails (5). The car frame (7) utilizes a cantilever design so that it requires only one car wall (19) to physically interface with the car guide rails (5). Such configuration allows, for example, an adjacent entrance (9). This is unique and advantageous in comparison to the system disclosed in U.S. Pat. No. 5,429,211, which positions the car guide rails on oppositely facing walls and thus requires strict dimensioning of the hoistway and guiderail hardware. For instance, the present elevator system can accommodate a variety of sizes of hoistways regardless of the spacing of opposing walls.

The drive sheave (2) of the embodiment shown is a traction sheave (2) that is angled as shown in FIG. 2 to enable the counterweight guide rails (6) to be positioned in between the car guide rails (5). Preferably, the traction sheave (2) is angled at 12.5 degrees. The counterweight deflector sheave (3) may also be angled, for example, at 15 degrees. This permits the two sets of guide rails (5, 6) to be mounted to a common, single hoistway wall (20). One advantage of such an arrangement is that the size of the hoistway (21) required to accommodate the system of the present invention can be made smaller than hoistways for traditional traction systems.

The layout of the elevator system (1) of the present invention can accommodate either a 1:1 or a 2:1 roping configuration which resides completely in the hoistway. This enables elimination of the conventional machine room. The traction machine (16) is mounted to the guide rails (6) or the hoistway wall (20), thus eliminating the forces applied to the ceiling (not shown) of the hoistway (21) that are present in conventional systems.

Figure 3:
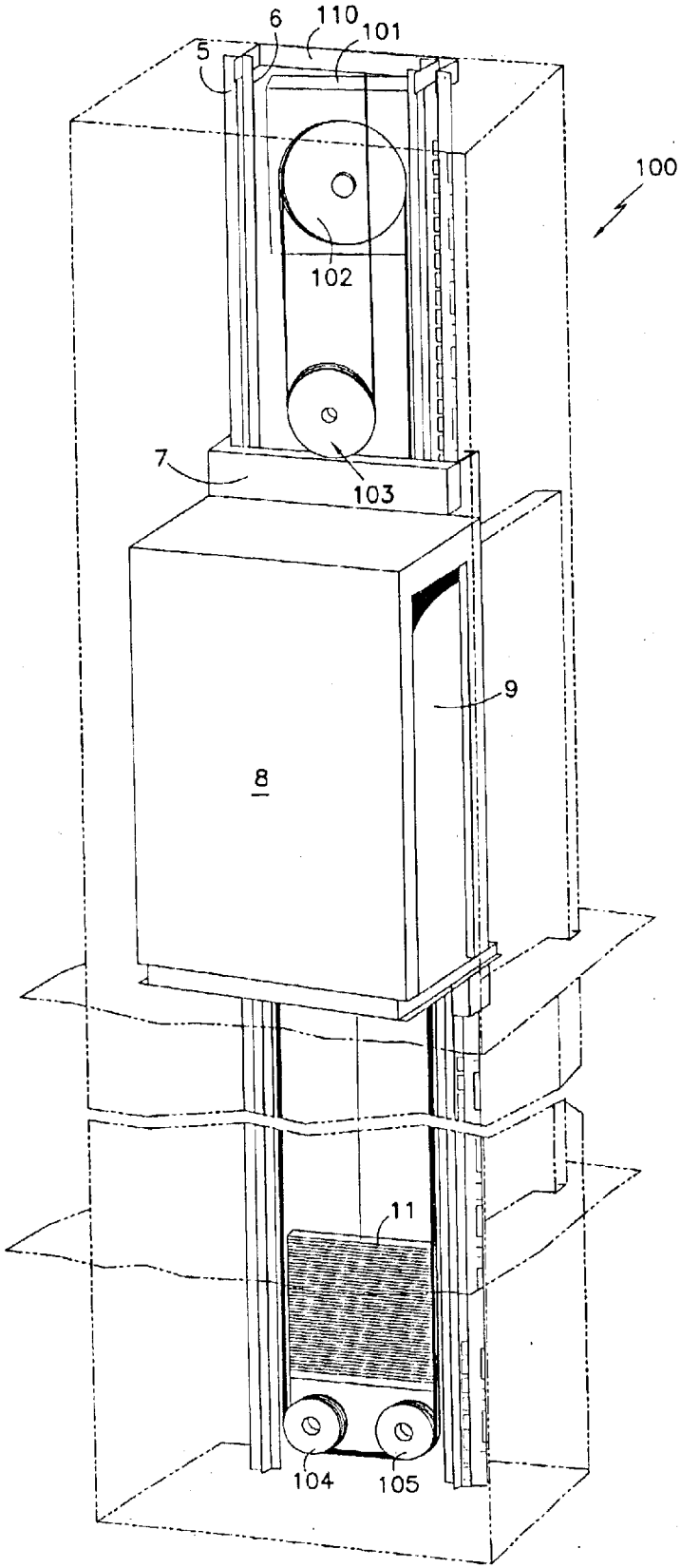
FIG. 3 is a schematic, partial, perspective view of an elevator system of a second embodiment of the present invention shown in a hoistway.

A second preferred embodiment of the present invention elevator system (100) is illustrated in FIGS. 3–4. Except where enumerated explicitly with respect to FIGS. 3–4, reference numerals that correspond to similar structure in the first preferred embodiment of FIGS. 1–2 will remain the same. The system (100) is similar to that of the first embodiment disclosed in FIGS. 1–2, except that it accommodates a 2:1 rope configuration and it utilizes a different drive machine. As shown in FIG. 4, the traction sheave (102) is mounted at an angle of 15 degrees relative to the hoistway wall (20). The traction sheave (102) and the machine housing (101) are mounted on a support (110) which is fixed to the car guide rails (5). The top deflection sheave (103) and two lower sheaves (104, 105) are aligned generally parallel to the hoistway wall (20) so that the four sheaves together form a compact "Z" shape as shown in FIG. 4. The compact configuration conserves space and, for example, may accommodate a flat machine such as the OTIS GM1 flat machine.

A third embodiment of the present invention is disclosed in FIG. 5. In FIG. 5, an elevator system (200) includes a pair of support columns (202, 204) aligned vertically and generally parallel within a hoistway (not shown). The columns (202, 204) are positioned along one side, so as to occupy a position adjacent to one wall of the hoistway. The columns (202, 204) are supported by the floor of the hoistway and may be free standing or attached to an overhead structure such as the hoistway ceiling. A lateral structural member (206), represented by dashed lines may be used to join the upper ends of the columns (202, 204) and to support components such us the motor (208) and sheave (210), and the counterweight (212).

Each support column (204, 206) includes an elevator car guide track (214, 216) and a counterweight guide track (218, 220). The guide tracks (214, 216, 218, 220) may be in the form of guide rails or other known guide track components. The guide tracks (214, 216, 218, 220) may be integrally formed with or fixed to the support columns (202, 204). The support columns (202, 204) may be constructed from any suitable material of sufficient strength and rigidity, such as steel or concrete, or a combination of materials.

An elevator car (222) is supported for vertical movement by the car guide tracks (214, 216) through interfacing track engagement members (224, 226), which may be in the form of mating slots or rail shoes or the like. The track engagement members (224, 226) are positioned along one wall of the elevator car (222) so that the car (222) may be suspended in cantilever fashion.

The counterweight (212) is supported for vertical movement by counterweight guide tracks (228, 230), which may be in the form of mating slots or rail shoes or the like. The counterweight guide tracks (228, 230) may be positioned on opposite sides (232, 234) of the counterweight (212) so that the counterweight (212) may be positioned in between the columns (202, 204) to optimize low profile of the overall assembly. To that end, the motor (208) and sheave (210) may be of the type referred to as an "elongated machine" in which the diameter dimension is relatively small in comparison to length. This enables the motor (208) and sheave (210) to be positioned directly over the counterweight (212) while maintaining an overall thin profile of the total assembly.

The embodiment disclosed in FIG. 2 eliminates the need for a machine room, while providing cost and time savings in assembly and manufacture. It reduces the structural requirements of the surrounding building structure, while improving operating and servicing safety and efficiency.

Figure 6:
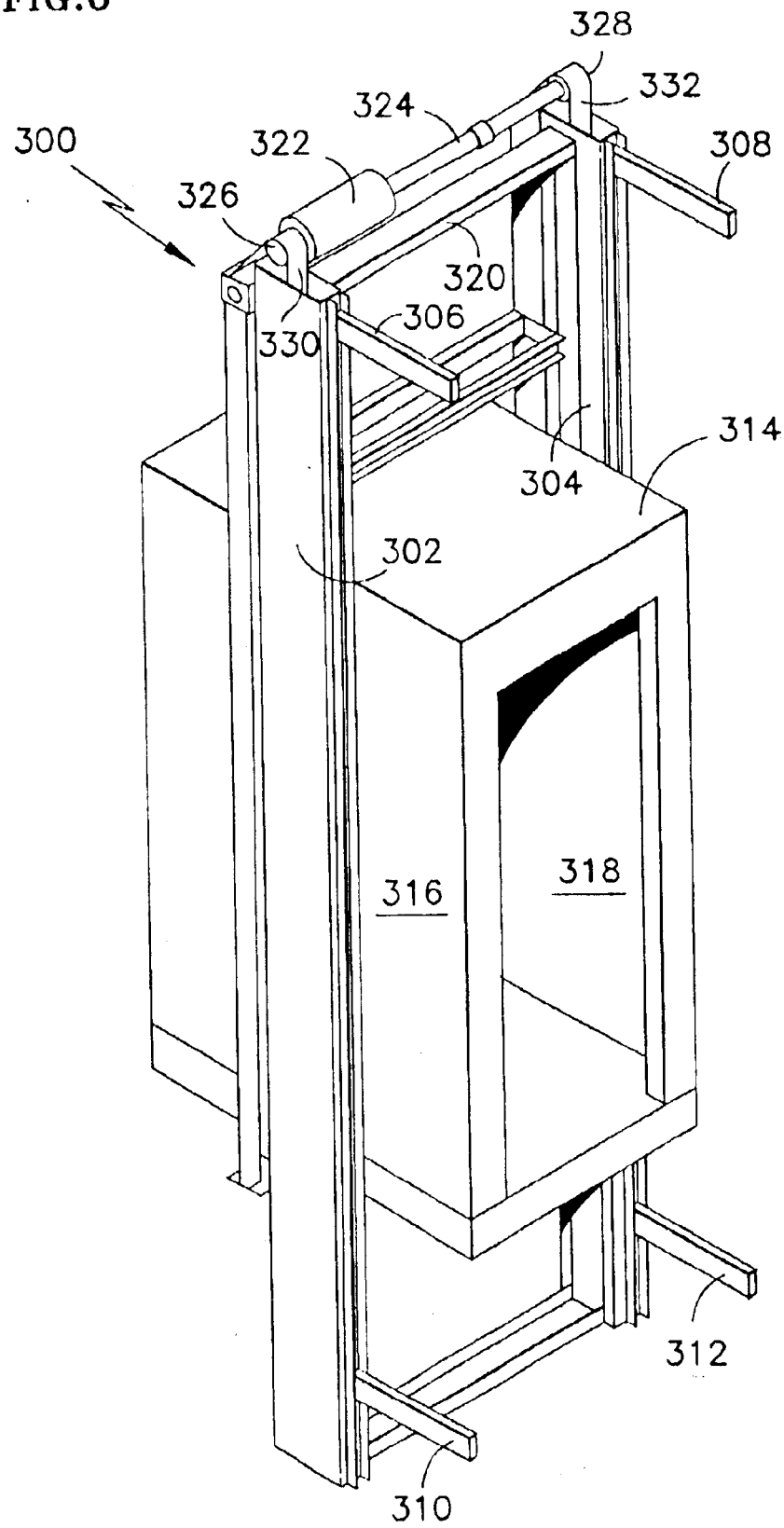
FIG. 6 is a schematic, orthogonal view of an elevator system according to a fourth embodiment of the present invention.

A fourth embodiment of the present invention elevator system (300) is shown in FIG. 6. A pair of vertical support columns (302, 304) are supported by the floor of a hoistway (not shown). Brackets (306, 308, 310, 312) may be provided, which extend from the columns (302, 304) and engage a wall (not shown) of the hoistway (not shown). The columns (302, 304) are spaced so as to receive an elevator car (314) in between them. Preferably, the columns (302, 304) are positioned adjacent to the side walls (316, 318) of the elevator car (314). One or both columns (302, 304) contain an internal channel to accommodate a counterweight (316) that is received therein for internal, vertical movement in a coupled relationship to the elevator car (314).

A cross beam (320) joins the top ends of the columns (302, 304) and supports a drive machine (322) and associated pulleys and rope. A drive shaft (324) drives one or two drive sheaves (326, 328). The use of two drive sheaves (326, 328), along with flat ropes (330, 332) optimizes drive traction while minimizing profile thickness.

Figure 7:
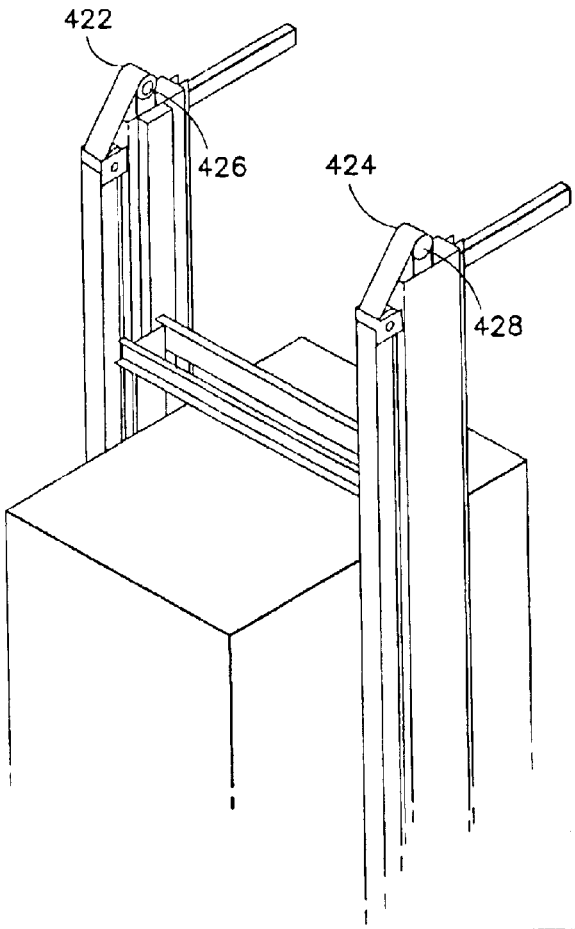
FIG. 7 is a schematic, orthogonal view of an elevator system according to a fifth embodiment of the present invention.

Optionally, a pair of synchronized machines (422, 424) having associated drive sheaves (426, 428) may be used in place of a single motor and shaft that couples two drive sheaves, as shown in FIG. 7. A controller (not shown) may be implemented to provide signals for synchronous driving of the machines (422, 424), and to provide control features such as slip detection and corrective operation of either or both machines (422, 424). The remaining components of the embodiment of FIG. 7 are essentially similar to those disclosed and described with respect to FIG. 4.

Figure 8:
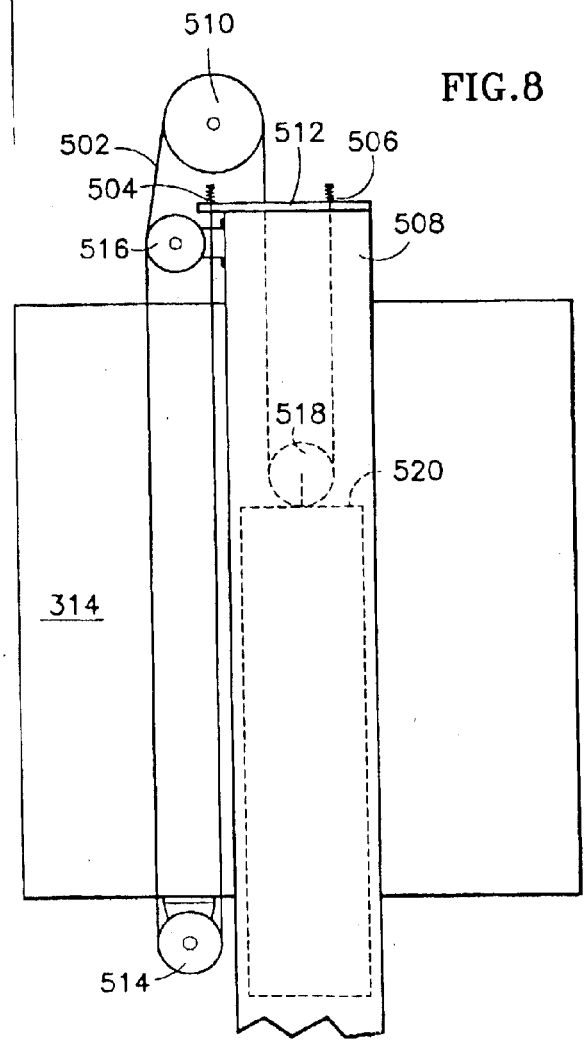
FIG. 8 is a schematic diagram of a roping arrangement for use with the embodiments disclosed in FIGS. 5–7.

A schematic representation of a 2:1 roping arrangement for use with the embodiments of FIGS. 5–7 is illustrated in FIG. 8. A 2:1 roping arrangement, in comparison to a direct roping arrangement, reduces required torque output for a given drive sheave diameter. This enables a smaller motor to be implemented. The drive rope (502), preferably a flat rope or belt, is fixed at first and second ends (504, 506). It is preferable, though not required, that the rope (502) be fixed to the support column (508). A motor (not shown) and associated drive sheave (510) are mounted, preferably, to a cross beam (512) fixed at the top of the support column (508) and a corresponding, parallel column (not shown).

The rope (502) extends vertically downward from its first end (504) and passes around an idler sheave (514) fixed to and thereby supporting the elevator car (314). The rope (502) then extends vertically and contacts a diverter pulley (516) before engaging the drive sheave (510). The rope (502) passes around the drive sheave (510) and extends down under and back up around an idler sheave (518) fixed to the counterweight (520) which is slidably received in an internal channel in the support column (508). The other end (506) of the rope is above the idler pulley (518) and fixed.

While the preferred embodiment has been disclosed herein, it is acknowledged that the novel elevator system of the present invention as presented may be configured in a variety of different ways without departing from the scope of the claimed invention.

What is claimed is:

1. An elevator system comprising an elevator car adapted to move within a hoistway;

a counterweight coupled to said elevator car for simultaneous movement;

a guide structure for guiding the movement of said elevator car an said counterweight;

drive means mounted to said guide structure for driving said elevator car and said counterweight;

a traction sheave aligned at an angle of about 15 degrees relative a first hoistway wall; and a top deflection sheave and two lower sheaves, each being aligned generally parallel to said first hoistway wall.

* * * * *